US006056565A

United States Patent [19]

Sawayanagi et al.

[11] Patent Number: 6,056,565

[45] Date of Patent: May 2, 2000

[54] LOW INSERTION FORCE SLIDING CAM ELECTRICAL CONNECTOR

[75] Inventors: Masahiro Sawayanagi; Nobuyuki Akeda, both of Shizuoka, Japan

[73] Assignee: Yazaki Corporation, Tokyo, Japan

[21] Appl. No.: 09/141,519

[22] Filed: Aug. 27, 1998

[30] Foreign Application Priority Data

Aug. 29, 1997 [JP] Japan ..... 9-234795

[51] Int. Cl.[7] ..... H01R 13/62

[52] U.S. Cl. ..... 439/157

[58] Field of Search ..... 439/157, 347, 439/310

[56] References Cited

U.S. PATENT DOCUMENTS 5,478,251 12/1995 Jaklin ..... 439/157

5,823,807 10/1998 Yamasaki et al. ..... 439/157

FOREIGN PATENT DOCUMENTS 9-17508 1/1997 Japan .

*Primary Examiner*—Steven L. Stephan

*Assistant Examiner*—Barry M. L. Standig

*Attorney, Agent, or Firm*—Sughrue, Mion, Zinn, Macpeak & Seas, PLLC

[57] ABSTRACT

A low insertion force connector in which the operability of a slider is enhanced so that a force, required for connecting terminals of one connector respectively to terminals of the other connector, will not affect the operability of the slider. Specifically, the low insertion force connector includes a first connector having follower projections, a second connector having a slider insertion hole, and a slider having cam grooves for respectively guiding the follower projections. The slider has at least one inertia insertion abutment projection for the follower projection, and the cam groove is formed in continuous relation to the abutment projection, and when the follower projection passes the abutment projection, terminals in the first connector are initially fitted respectively into terminals in the second connector. The first connector includes a pair of terminal receiving blocks, and a pair of follower projections are provided in a slit groove, formed between the pair of terminal receiving blocks, in opposed relation to each other. The cam grooves are formed respectively in opposite sides of the slider, and the abutment projection is formed on each or one of the opposite sides of the slider.

3 Claims, 11 Drawing Sheets

LOW INSERTION FORCE SLIDING CAM ELECTRICAL CONNECTOR

BACKGROUND OF THE INVENTION

1. Field of the Invention

This invention relates to a low insertion force connector in which before a slider is pushed or operated, terminals in one connector are initially connected respectively to terminals in the other connector by an inertia force obtained when the connectors are pushed relative to each other to be fitted together, thereby reducing a force required for operating the slider.

2. Description of the Related Art

FIGS. 12A and 12B shows a conventional low insertion force connector.

This low insertion force connector 50 comprises a male connector 52 including a plurality of female terminals 51, a female connector 54 including a plurality of male terminals 53 corresponding respectively to the female terminals 51, and a plate-like slider (not shown) for fitting the male and female connectors 52 and 54 together.

The slider is inserted into the female connector 54, and follower projections of the male connector 52 are guided along cam grooves in the slider, thereby fitting the two connectors 52 and 54 together (see Japanese Patent Unexamined Publication No. Hei. 9-17508). The slider will be described later in detail in "DETAILED DESCRIPTION OF THE PREFERRED EMBODIMENT" of this specification.

As shown in an enlarged view of FIG. 12B, the female terminal 51 has a resilient contact piece portion 56 provided within a tubular electrical contact portion 55 of a rectangular cross-section forming a distal end portion of the female terminal. The male terminal 53 has a plate-like male tab portion 57 for contact with the resilient contact piece portion 56. When the slider is pushed, the male and female connectors 52 and 54 begin to be fitted together, and the male tab portion 57 of each male terminal 53 is inserted into the electrical contact portion 55 of the associated female terminal 51, and causes the associated resilient contact piece portion 56 to be flexed or resiliently deformed.

In the above conventional construction, however, the male and female terminals 53 and 51 have now been arranged into a multi-pole design, and therefore an increased force is required for flexing the resilient contact piece portions 56 of the female terminals 51 by the male tab portions 57 of the male terminals 53, and as a result there has been encountered a problem that an initial inserting force 25 for the slider is increased as shown in FIG. 13, so that the pushing operability of the slider is adversely affected. In FIG. 13, a peak 58 immediately before the completion of insertion of the slider is due to the locking of the connectors.

SUMMARY OF THE INVENTION

With the above problem in view, it is an object of this invention to provide a low insertion force connector in which the increase of an initial slider-inserting force, which is due to the flexing of resilient contact piece portions of female terminals by male terminals when fitting two connectors together, is prevented, so that the pushing operability of the slider can be enhanced.

In order to achieve the above object, according to the present invention, there is provided a low insertion force connector comprising: a first connector having at least one follower projection; a second connector having a slider insertion hole; and a slider having at least one cam groove for guiding the follower projection, wherein the slider has an inertia insertion abutment projection for the follower projection, and the cam groove is formed in continuous relation to the abutment projection, and wherein when the follower projection passes the abutment projection, terminals in the first connector are initially fitted respectively into terminals in the second connector.

DETAILED DESCRIPTION OF THE PREFERRED EMBODIMENT

A preferred embodiment of the present invention will now be described in detail with reference to the drawings.

FIGS. 1 to 4 show a general construction of a low insertion force connector of the present invention.

Figure 1:
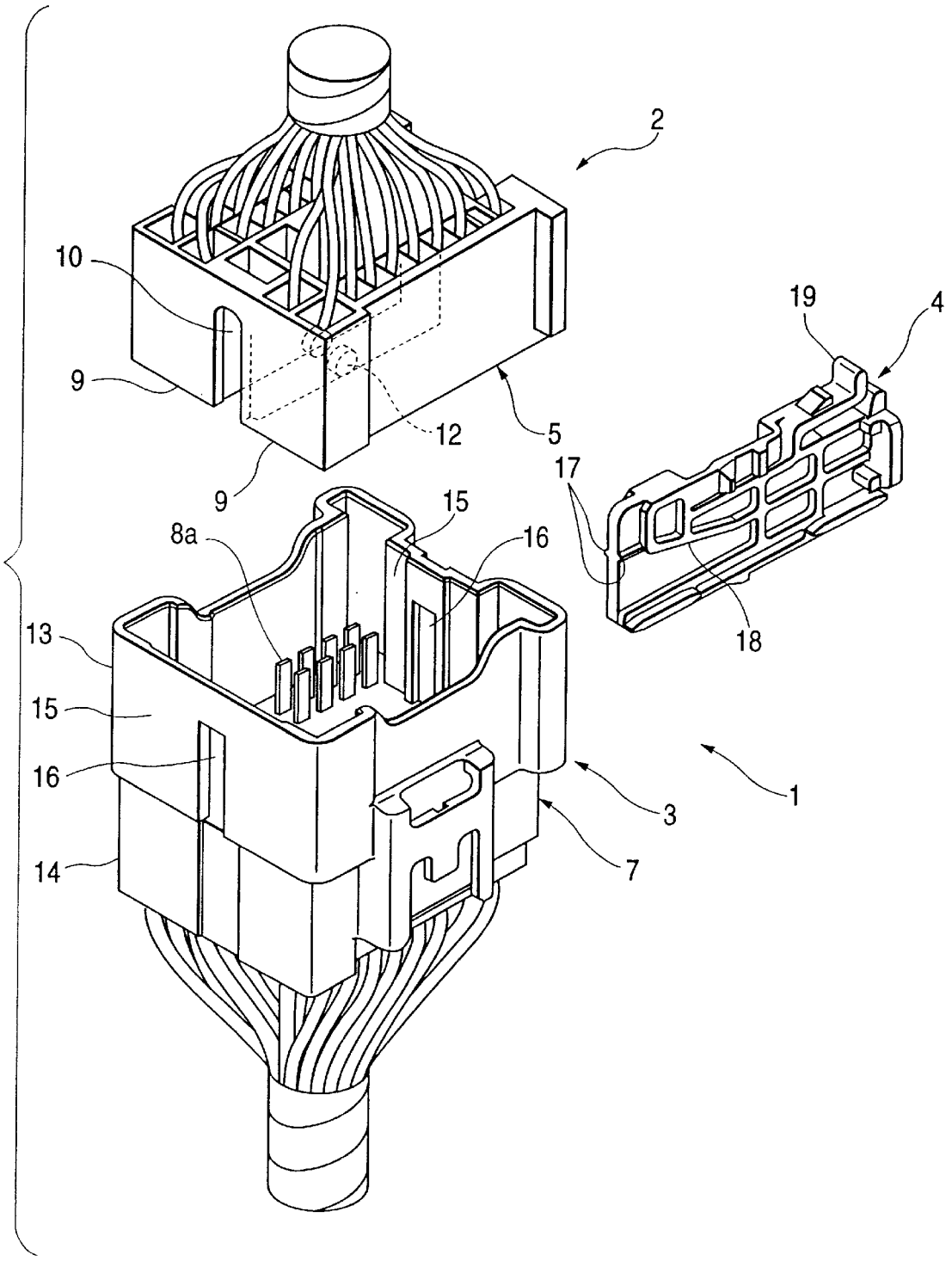
FIG. 1 is an exploded, perspective view showing a general construction of a low insertion force connector of the present invention.

As shown in FIG. 1, this low insertion force connector 1 comprises a male connector 2, a female connector 3, and a slider 4. The male connector 2 comprises a male connector housing 5 made of synthetic resin, and female terminals 6 (FIG. 2) received within the male connector housing 5. The female connector 3 comprises a female connector housing 7 made of synthetic resin, and male terminals 8 (FIG. 2) received within the female connector housing 7. The slider 4 is made of synthetic resin, and has a plate-like shape, and can be inserted into the female connector 3 in a direction perpendicular to a connector fitting direction.

The male connector housing 5 includes a pair of front and rear terminal receiving blocks 9 and 9, and has a substantially inverted U-shape, and this housing 5 has a slider passage slit groove 10 formed between the pair of terminal receiving blocks 9 and 9. A pair of short, cylindrical follower projections 12 and 12 are formed respectively on inner walls 11 (FIG. 2) of the terminal receiving blocks 9, and are disposed within the slit groove 10.

The female connector housing 7 includes a connector fitting portion 13, and a terminal receiving portion 14, and slit-like slider insertion holes 16 and 16 are formed respectively through central portions of opposite side walls 15 and 15 of the connector fitting portion 13. Male tab portions 8*a* of the male terminals 8 are disposed in a projected manner on opposite sides of a plane in which the two slider insertion holes 16 are disposed.

The slider 4 has a pair of provisionally-locking (inertia insertion) projections (abutment projections) 17 formed at a front end portion thereof, these elongate projections 17 corresponding respectively to the pair of follower projections 12 of the male connector 2. A tapering cam groove 18 for guiding the follower projection 12 is formed in each side of the slider 4, and extends from the projection 17 to a central portion of the slider. A lock arm 19 is formed at a rear end portion of the slider 4.

Figure 2:
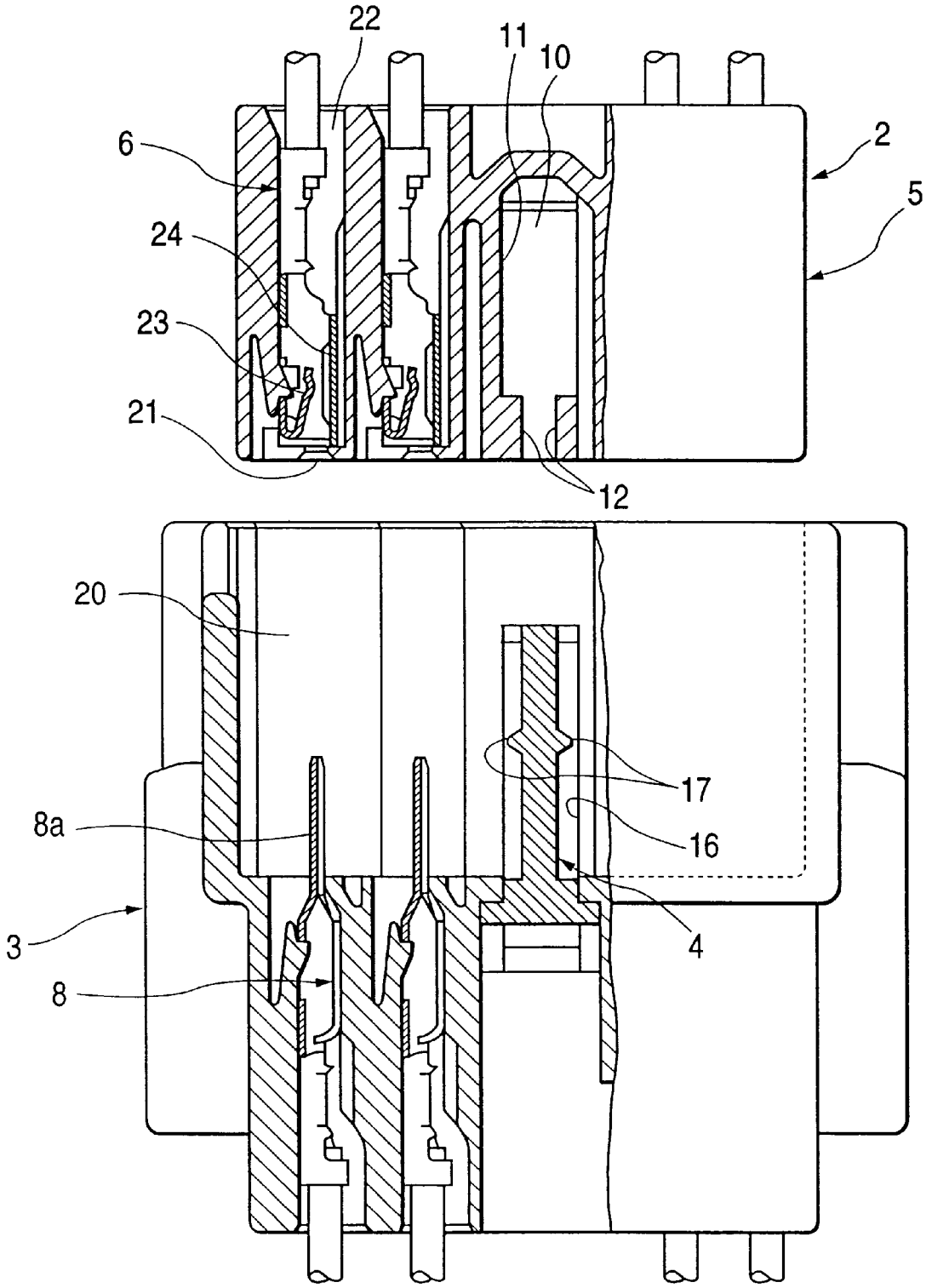
FIG. 2 is a vertical cross-sectional view showing a condition in which a male connector is to be fitted into a female connector.

As shown in FIG. 2, the slider 4 is initially inserted into the female connector 3 through the insertion hole 16, and the provisionally-locking projections 17 are located at a central portion of a connector fitting chamber 20, and are disposed respectively beneath the follower projections 12. The male tab portions 8*a* within the connector fitting chamber 20 are disposed below the provisionally-locking projections 17. The pair of follower projections 12 are provided immediately adjacent to the front end of the male connector 2. Male tab insertion holes 21 are formed in the front end of the male connector housing 5, and the female terminals 6 are received respectively in terminal receiving chambers 22 communicating respectively with the male tab insertion holes 21. A resilient contact piece portion 23 of the female terminal 6 is almost in contact with that wall of a tubular electrical contact portion 24 facing this portion 23, the electrical contact portion 24 having a rectangular cross-section.

Figure 3:
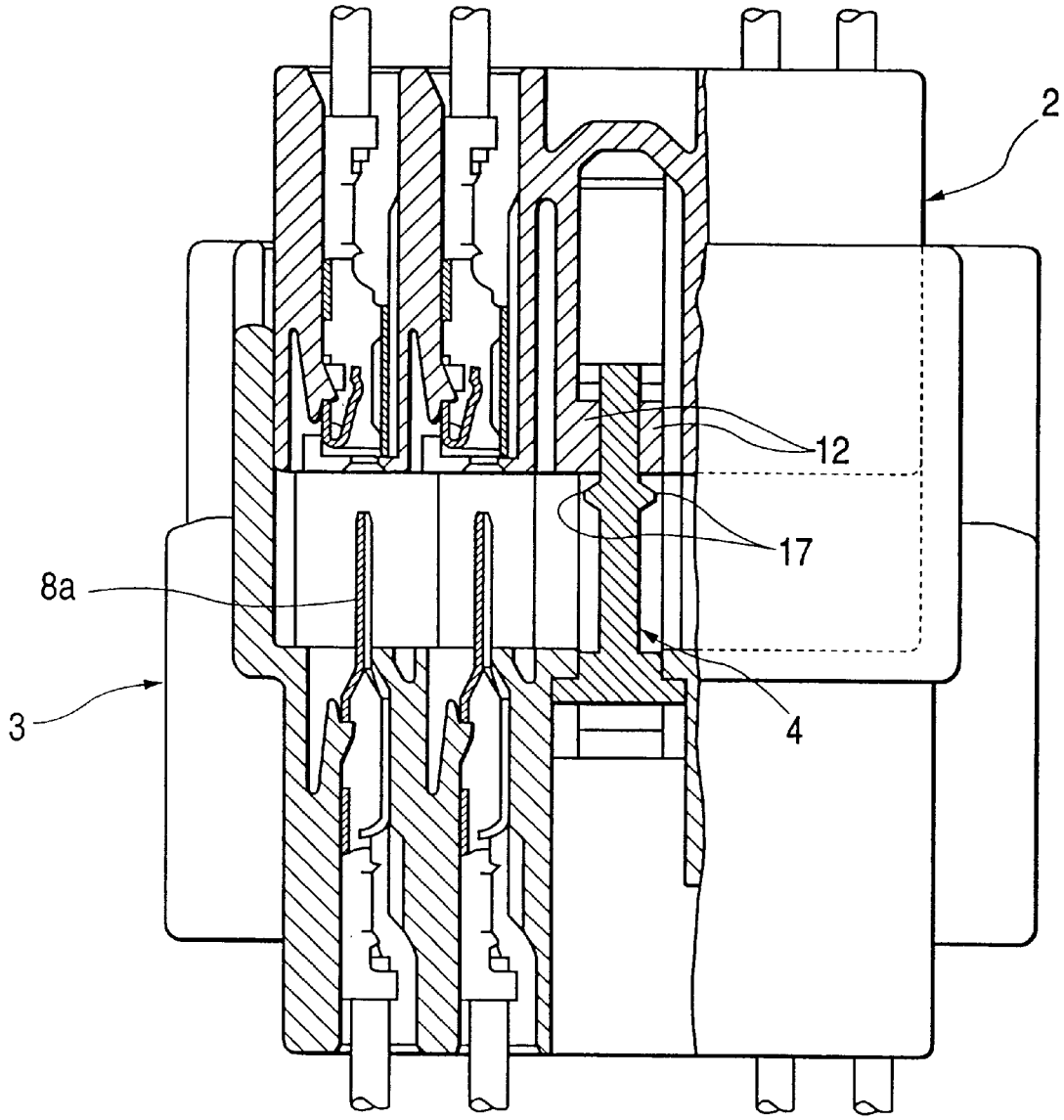
FIG. 3 is a vertical cross-sectional view showing a condition in which follower projections are abutted against abutment projections, respectively.

As shown in FIG. 3, when the male connector 2 is initially fitted into the female connector 3, the pair of follower projections 12 are brought into abutting engagement with the pair of provisionally-locking projections 17 of the slider 4, respectively. At this time, the male terminals 8 do not yet contact the female terminals 6, respectively. The pair of follower projections 12 are held respectively against the provisionally-locking projections 17 until a predetermined load is applied. As a result, a pressing or pushing force is stored.

Figure 4:
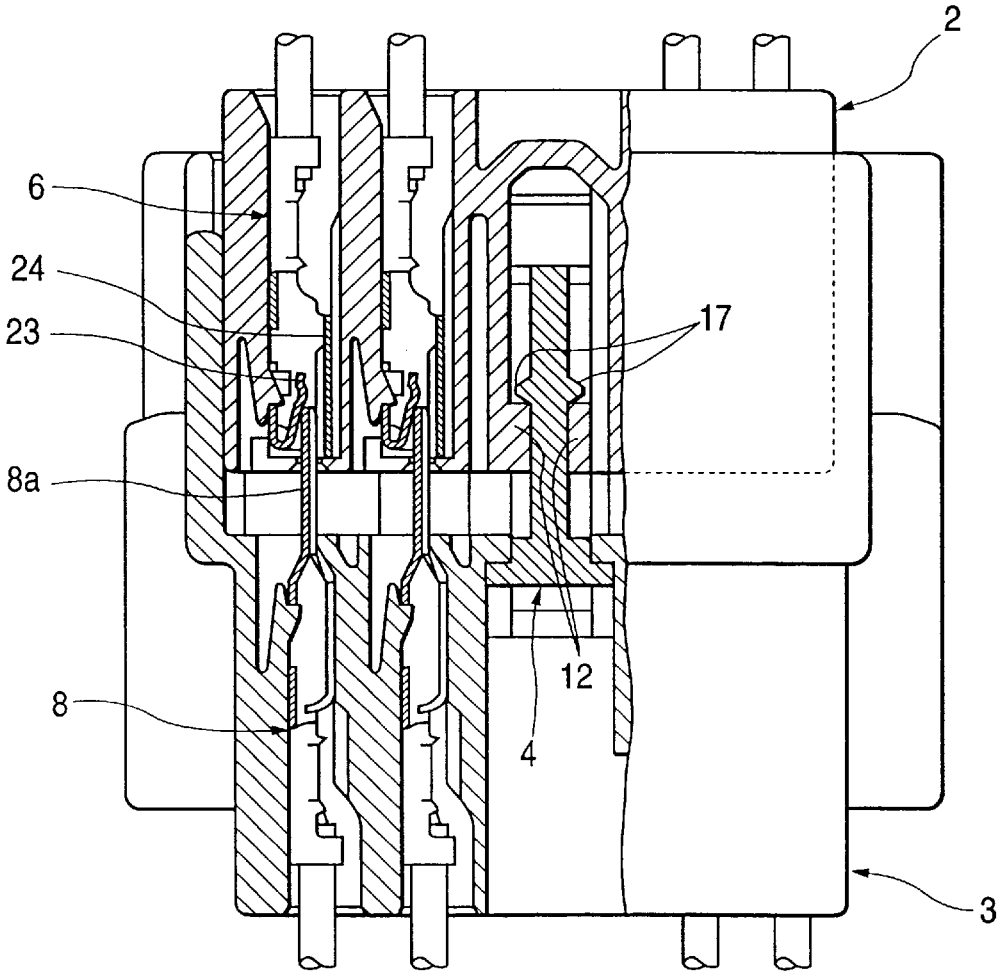
FIG. 4 is a vertical cross-sectional view showing a condition in which the follower projections have passed the abutment projections, respectively.

As shown in FIG. 4, when the pushing force (load), acting on the male connector 2, exceeds a certain value, the follower projections 12 pass the provisionally-locking projections 17, respectively. At this time, the male tab portion 8*a* of each male terminal 8 is initially inserted into the electrical contact portion 24 of the associated female terminal 6, and flexes the resilient contact piece portion 23. Namely, the male terminals 8 are initially inserted into (that is, initially connected to) the female terminals 6, respectively, by an inertia force obtained when the follower projections 12 pass the provisionally-locking projections 17, respectively. This inertia force is produced since the pushing force is stored when the follower projections 12 are brought into engagement with the projections 17, respectively.

In this condition, the slider 4 is pushed, thereby fitting the male and female connectors 2 and 3 together. More specifically, when the slider 4 is pushed in the inserting direction (see FIG. 1), each follower projection 12 shifts from the provisionally-locking projection 17 to the tapering cam groove 18, and is guided in the connector fitting direction along the cam groove 18. As a result, the male connector 2 is drawn into the female connector 3, and is fitted thereinto.

Figure 5:
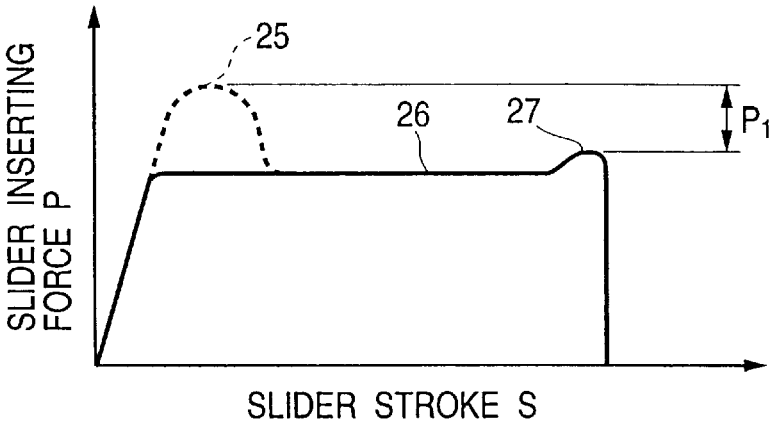
FIG. 5 is a diagram showing the relation between the stroke of a slider and the inserting force.

FIG. 5 shows the relation between the slider inserting force P and the stroke S of the slider, and as shown in this Figure, at an initial stage of the insertion of the slider 4, the initial mutual fitting connection between the terminals 6 and the terminals 8 has already been completed by the inertia force of the male connector 2, and therefore an initial load peak 25 as encountered with the conventional construction will not develop. Therefore, the slider 4 can be smoothly operated or inserted. At an intermediate stage of the insertion, each male tab portion 8*a* need only to slide over the associated resilient contact piece portion 23 which has already been flexed, and therefore a substantially horizontal, stable inserting force diagram 26 is obtained. Although the inserting force is slightly increased at 27 because of the engagement of connector lock means immediately before the two connectors are completely fitted together, this increase amount is very much smaller as compared with the increase 25 of the initial inserting force as encountered with the conventional construction. The inserting force is reduced by an amount corresponding to the difference $P_1$ between the two load peaks 25 and 27.

FIGS. 6 to 11 show the detailed construction of the above low insertion force connector (The portions identical to those of the above embodiment will be designated by identical reference numerals, respectively).

Figure 6:
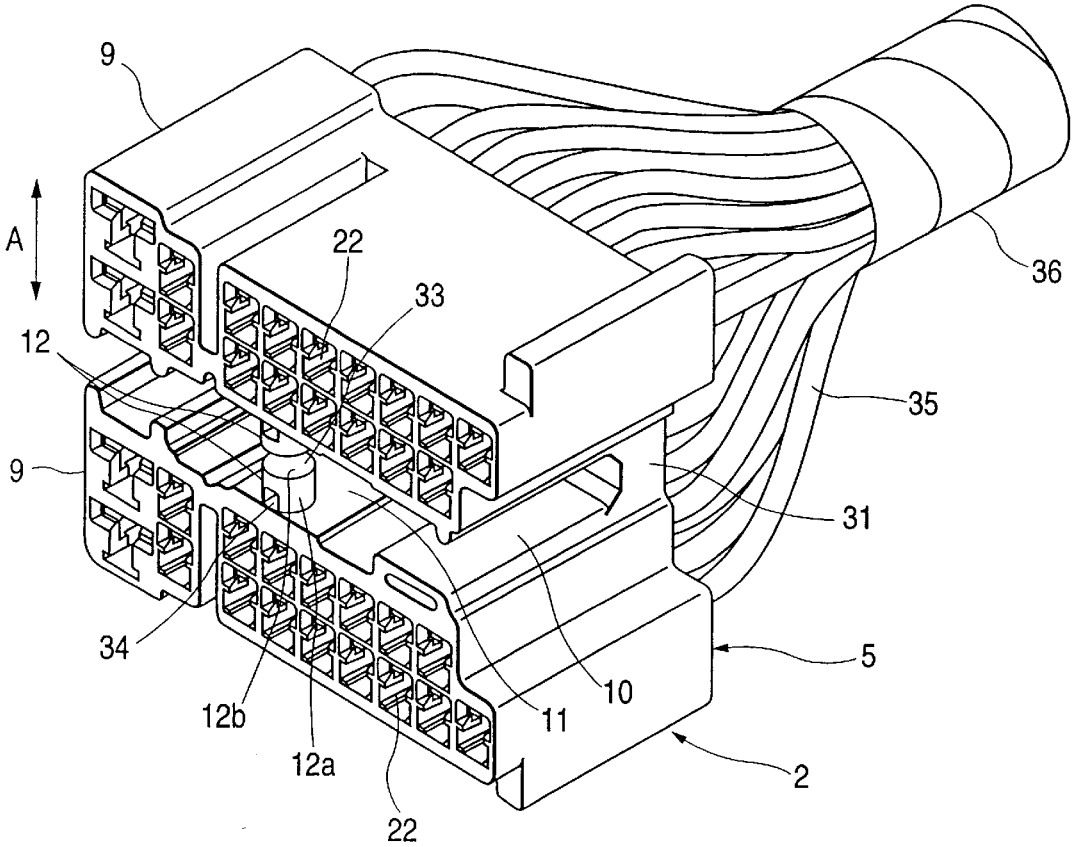
FIG. 6 is a perspective view showing a detailed construction of the male connector.

FIG. 6 shows the male connector 2, and the male connector housing 5 made of synthetic resin includes the pair of terminal receiving blocks 9 and 9, and many terminal receiving chambers 22 are formed in each terminal receiving block 9. The slit groove 10 between the pair of terminal receiving blocks 9 and 9 has a considerable depth, and the pair of terminal receiving blocks 9 and 9 are interconnected by a groove bottom portion 31. The pair of terminal receiving blocks 9 and 9 can be slightly flexed or turned about the groove bottom portion 31 in directions of arrow A.

The pair of opposed short, cylindrical follower projections 12 are formed respectively on the inner walls 11 of the terminal receiving blocks 9, and are disposed immediately adjacent to the front ends of these blocks 9, respectively. Each follower projection 12 is fixedly secured at one end to the inner wall 11, and a cylindrical peripheral surface 12*a* thereof is perpendicular to the inner wall 11, and the other end surfaces 12*b* of these follower projections 12 are flat, and are opposed to each other. The front side of the peripheral surface 12*a* of the follower projection 12 is brought into abutting engagement with the provisionally-locking (inertia insertion) projection (abutment projection) 17 of the slider 4 (FIG. 7), the projections 17 being elongate. An insertion gap 33 for passing a thinned portion 32 and the provisionally-locking projection 17 of the slider 4 therethrough is formed between the other end surfaces 12*b* of the follower projections 12.

A hole 34, extending in the connector fitting direction, is formed in the cylindrical peripheral surface 12*a* of each follower projection 12. Because of the provision of this hole 34, the follower projection 12 can be slightly elastically compressed axially. The female terminals (not shown), received respectively in the terminal receiving chambers 22, are connected respectively to wires 35, and these wires 35 constitute a wire harness 36.

Figure 7:
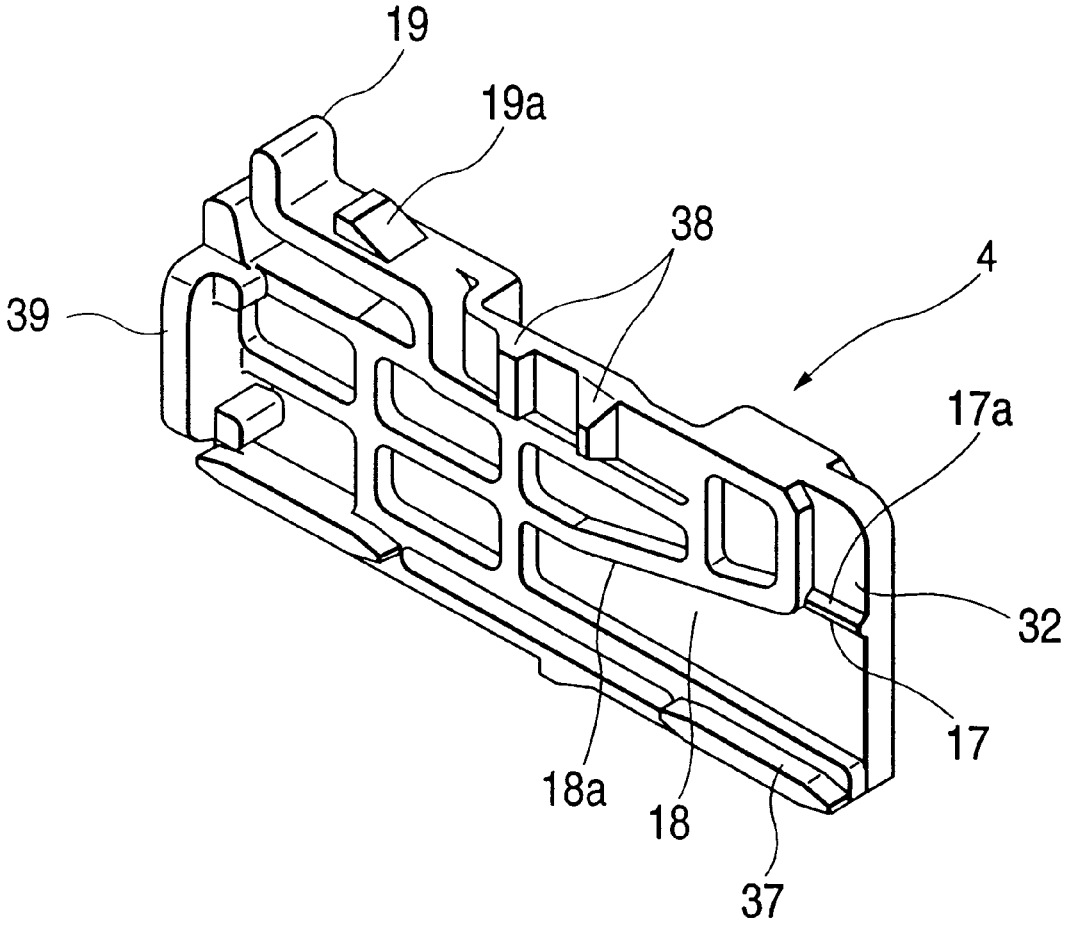
FIG. 7 is a perspective view showing a detailed construction of the slider.

FIG. 7 shows the slider 4 made of synthetic resin. In this example, the provisionally-locking projection 17 is formed on only one side of the slider 4. The provisionally-locking projection 17 is formed on the thinned portion 32, and extends in a direction (slider inserting direction) perpendicular to the connector fitting direction. The elongate projection 17 has a substantially triangular or trapezoidal transverse cross-section, and has a tapering outer surface 17*a* defined by upper and lower inclined surfaces juxtaposed in the connector fitting and removing directions. The elongate projection 17 may have a semi-circular cross-section as shown in FIG. 1.

The length of the elongate projection 17 is slightly larger than the diameter of the follower projection 12 so that the follower projection 12 can be positively brought into abutment engagement with the projection 17. The cam grooves 18 are formed in the opposite sides of the slider 4, respectively, and each of these cam grooves 18 has a slanting surface (cam surface) 18*a* for drawing the male connector. The cam groove 18 is formed in continuous relation to the provisionally-locking projection 17.

An elongate guide projection 37 for the female connector 3 is formed at the lower portion of the slider 4, and provisionally-retaining projections 38 for the female connector 3 are formed at the upper portion of the central portion of the slider 4. The lock arm 19, having a lock projection 19*a* for the female connector 3, is formed at the rear portion of the upper portion of the slider 4, and a flange-like press operation portion 39 is formed at the rear end portion of the slider 4.

Figure 8:
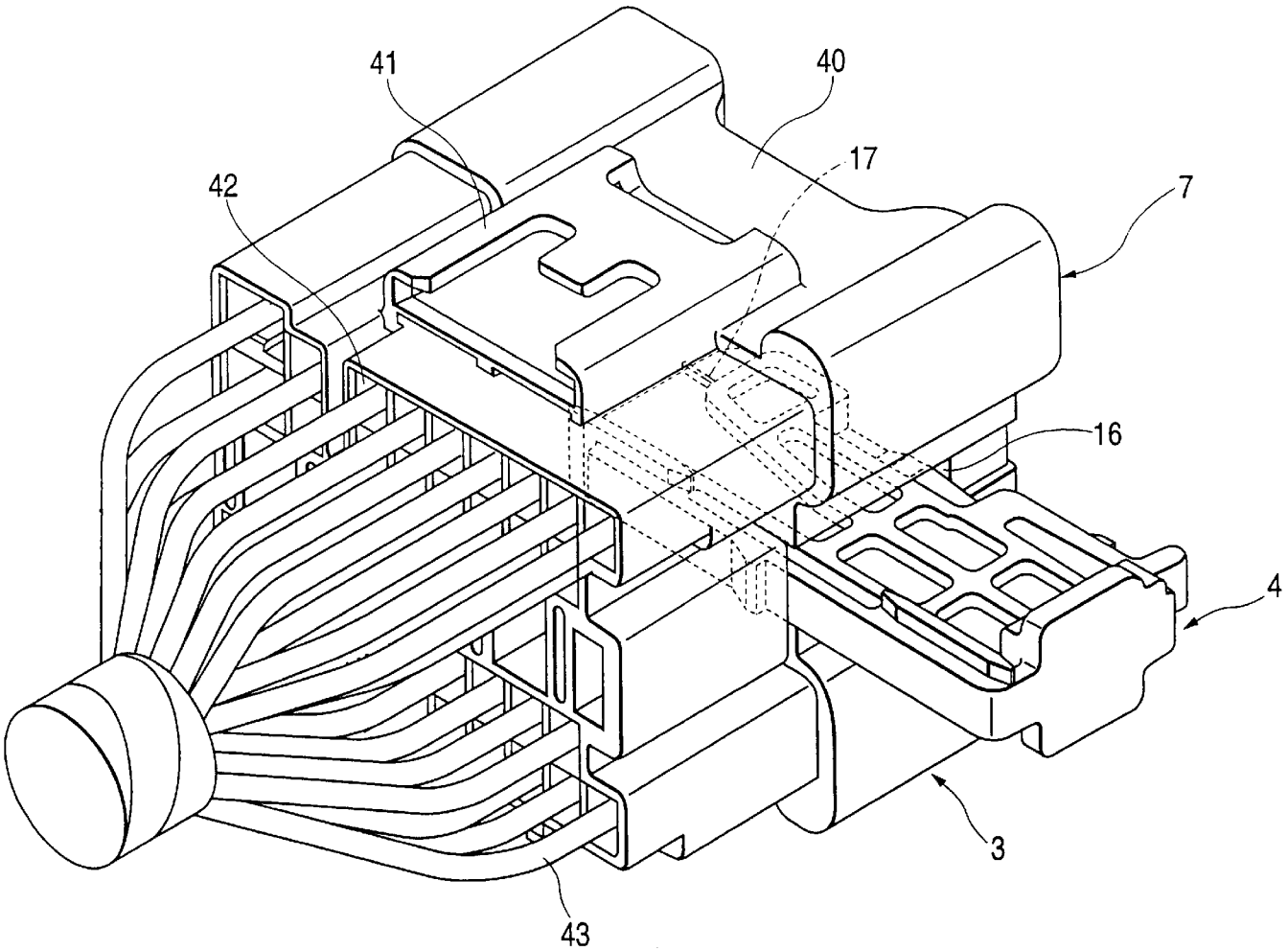
FIG. 8 is a perspective view showing a condition in which the slider is initially inserted into the female connector.

FIG. 8 shows a condition in which the slider 4 is initially fitted (half fitted) into the female connector 3. The slider 4 is passed through the slider insertion hole 16 (in the form of a rectangular slit), and is provisionally retained on the female connector housing 7 by the provisionally-retaining projections 38 (FIG. 7). The provisionally-locking projection 17 is disposed at the central portion of the female connector 3. In FIG. 8, for convenience' sake, the provisionally-locking projection 17 is shown on the opposite side of the slider 4. An engagement guide 41 for a bracket on a vehicle body (not shown) or the like is provided on a rear wall 40 of the female connector housing 7. Wires 43 are connected respectively to the male terminals (not shown) received respectively in a plurality of terminal receiving chambers 42 in the female connector housing 7.

Figure 9:
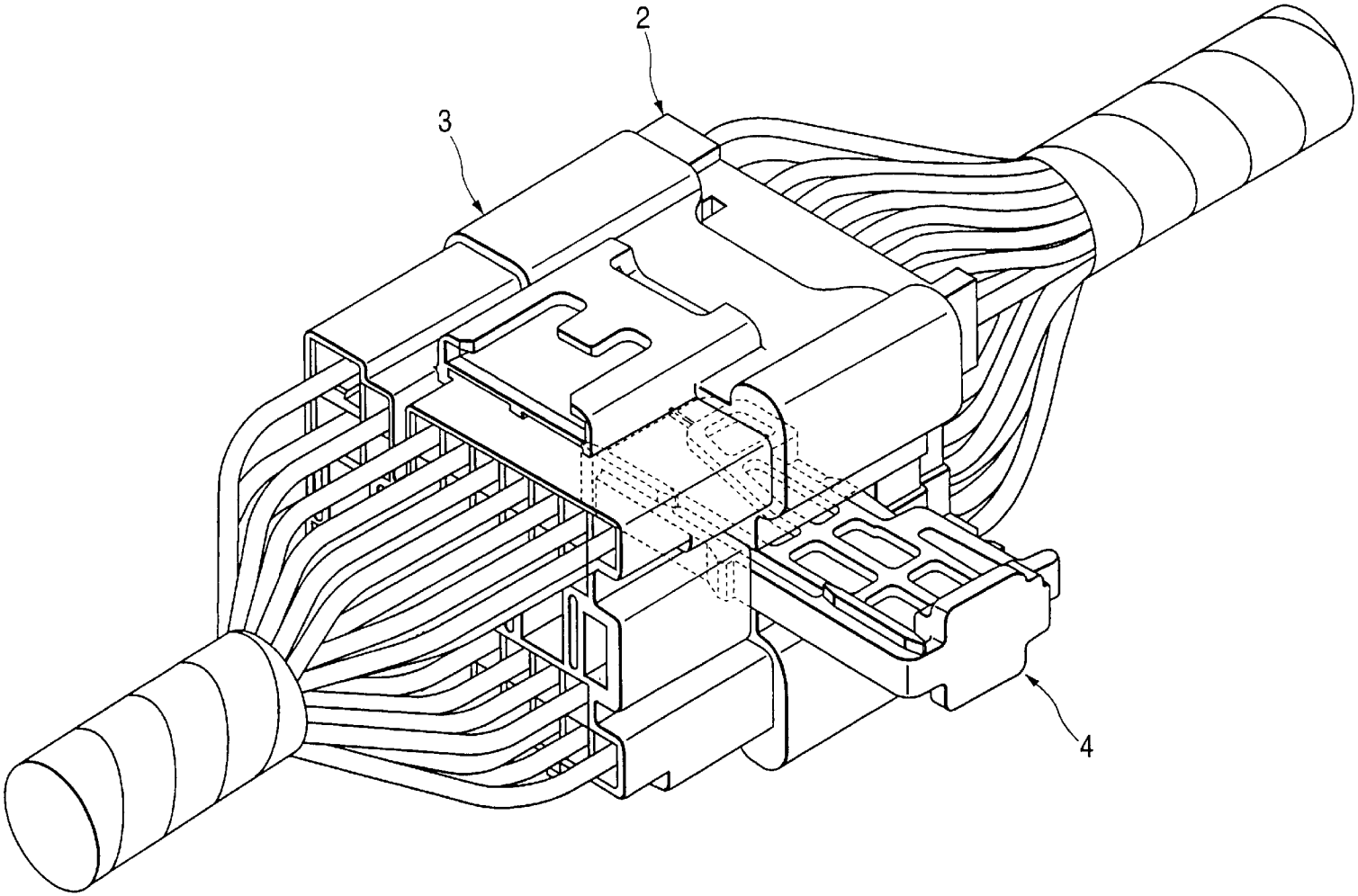
FIG. 9 is a perspective view showing a condition in which the male connector is initially fitted into the female connector.
Figure 10:
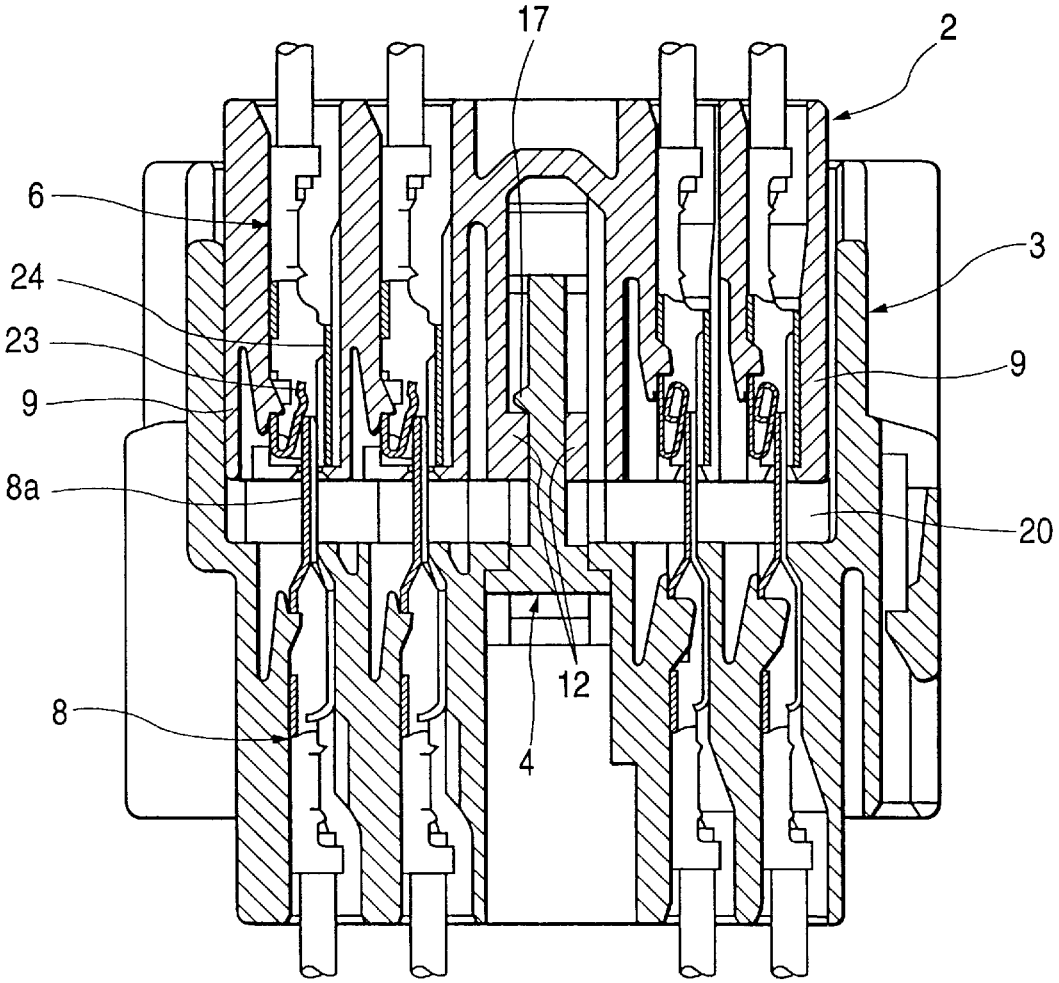
FIG. 10 is a vertical cross-sectional view showing the condition in which the male connector is initially fitted into the female connector.

FIGS. 9 and 10 show a condition in which the male connector 2 is initially fitted into the female connector 3. Namely, when the male connector 2 is pushed toward the female connector 3, the pair of follower projections 12 (FIG. 10) pass the provisionally-locking projection 17, and because of this inertia force, the male tab portions 8*a* of the male terminals 8 are inserted respectively into the electrical contact portions 24 of the female terminals 6, thereby flexing or resiliently deforming the resilient contact piece portions 23. In this example, there is provided one provisionally-locking projection 17, and therefore the pushing force, required for pushing the male connector 2, is smaller. If there are provided two provisionally-locking projections 17 as in the preceding embodiment, a larger pushing force is required, but in this case the increased inertia force is obtained.

When the follower projections 12 are to pass the provisionally-locking projection 17, the pair of terminal receiving blocks 9 and 9 are flexed outwardly within the range of a gap available in the connector fitting chamber 20 of the female connector 3, or each follower projection 12 is elastically compressed axially while contracting the hole 34 (FIG. 6) therein, so that the follower projections 12 can positively pass the projection 17.

Figure 11:
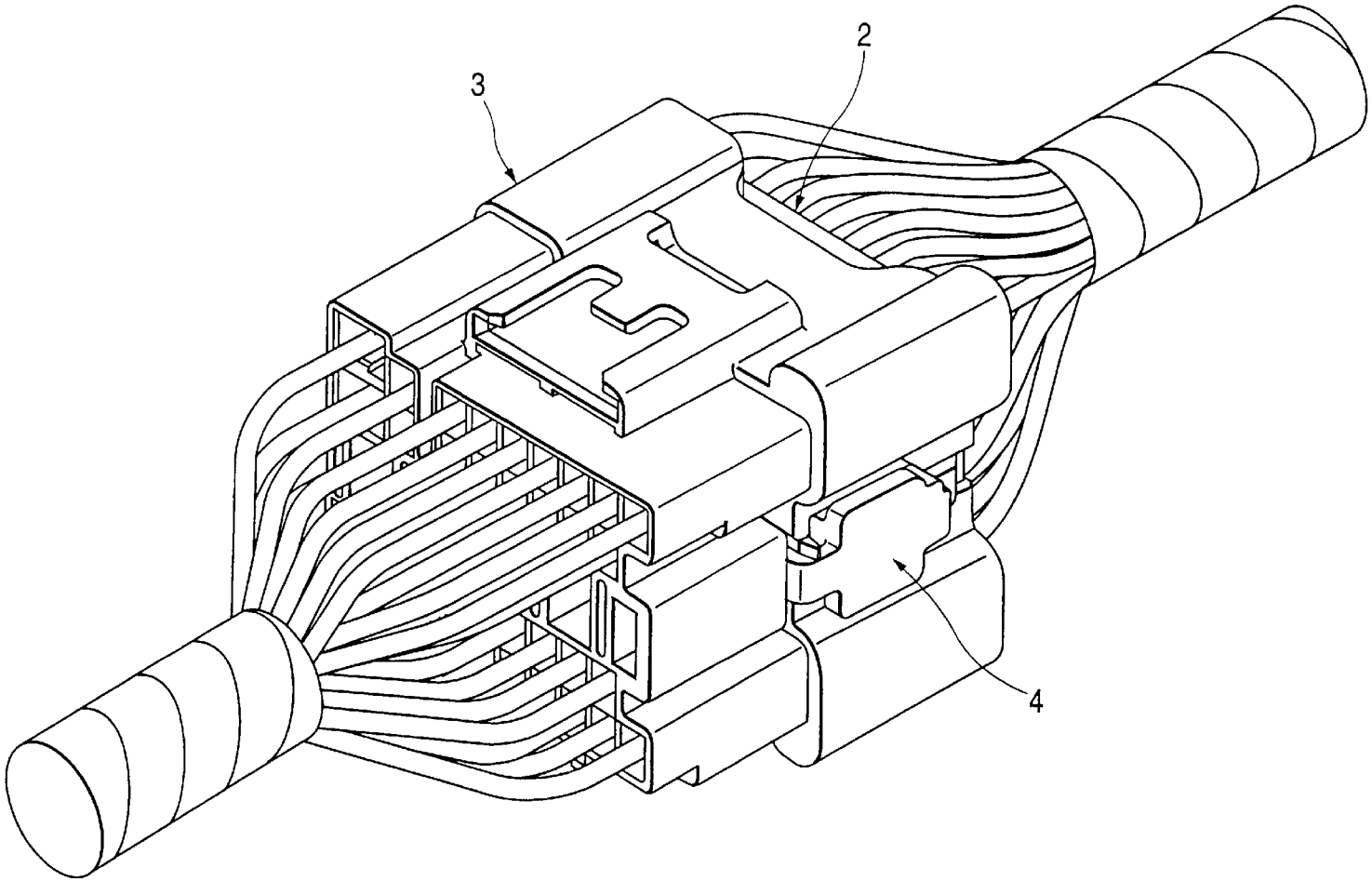
FIG. 11 is a perspective view showing a condition in which the male and female connectors are completely fitted together.
Figure 12A:
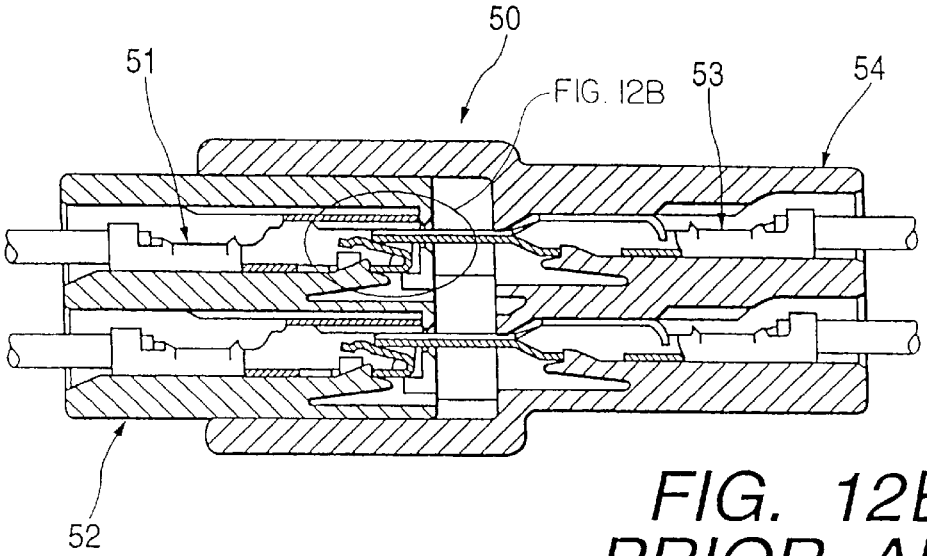
FIG. 12A PRIOR ART
FIG. 12A is a vertical cross-sectional view showing an initially-fitted condition of a conventional construction.
Figure 12B:
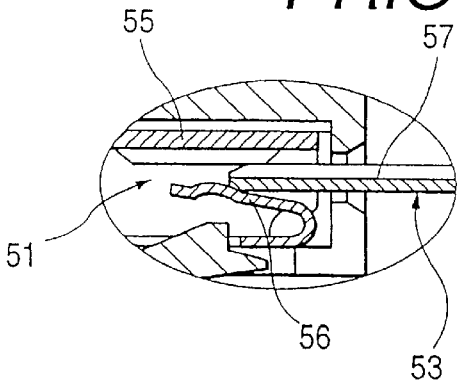
FIG. 12B PRIOR ART
FIG. 12B is an exploded view of a portion of FIG. 12A.
Figure 13:
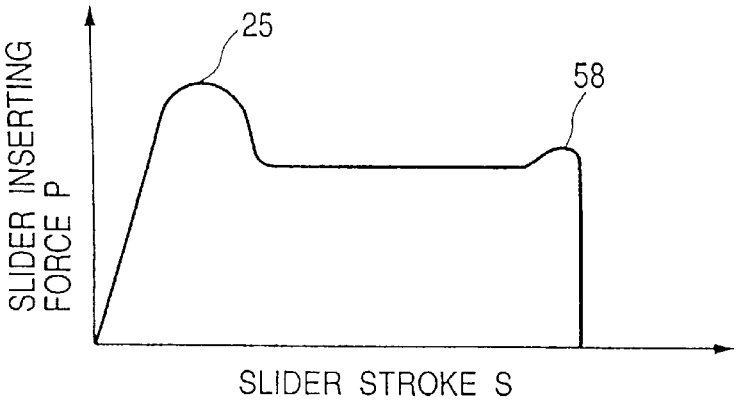
FIG. 13 PRIOR ART
FIG. 13 is a diagram showing the relation between the stroke of a conventional slider and the inserting force.

FIG. 11 shows a condition in which the male and female connectors 2 and 3 are completely fitted together. When the slider 4 is pushed from the condition shown in FIG. 9, each follower projection 12 slides along the associated cam surface 18*a* (FIG. 7) of the slider 4, and the male connector 2 is drawn toward the female connector 3, and is fitted thereinto.

As described above, in the invention, when the connector is pushed in the connector fitting direction, the follower projection is brought into abutting engagement with the abutment projection, and when a pushing force, larger than a predetermined level, is applied, the follower projection passes the abutment projection, and because of this inertia force, the terminals in one connector are initially fitted into the terminals in the other connector, respectively, so that the resilient contact piece portion of each of the terminals in one of the two connectors is flexed, and therefore when the slider is to be operated or pushed, the resilient contact piece portions of the terminals have already been flexed, and therefore there is not required a force for flexing the resilient contact piece portions. As a result, the initial operating force for the slider is reduced, and the operability is enhanced. Besides, since the cam groove is provided in continuous relation to the abutment projection, the follower projection, moved past the abutment projection, can be smoothly guided into the cam groove, and the connector fitting operation can be positively effected by inserting the slider.

What is claimed is:

1. A low insertion force connector comprising:

a first connector having at least one follower projection;

a second connector having a slider insertion hole; and a slider having at least one cam groove for guiding the follower projection, said slider insertable through said slider insertion hole, wherein said slider has an inertia insertion abutment projection engaging the follower projection, said abutment projection being aligned with said cam groove, and wherein when the follower projection passes the abutment projection, terminals in said first connector are initially fitted respectively into terminals in said second connector by an inertia force.

2. The low insertion force connector according to claim 1, wherein said first connector includes a pair of terminal receiving blocks, and a pair of the follower projections are provided in a slit groove, formed between the pair of terminal receiving blocks, in opposed relation to each other.

3. The low insertion force connector according to claim 2, wherein the cam groove is formed in each of opposite sides of said slider, and the abutment projection is formed on each or one of the opposite sides of said slider.

* * * * *